United States Patent [19]

Kandel

[11] 4,005,512

[45] Feb. 1, 1977

[54] ELECTROPHOTOGRAPHIC TONER REMOVAL BRUSH AND METHOD OF MAKING SAME

[76] Inventor: Thomas G. Kandel, 100 E. Hartsdale Ave., Hartsdale, N.Y. 10530

[22] Filed: Oct. 23, 1975

[21] Appl. No.: 625,051

[52] U.S. Cl. ..... 29/120; 300/21
[51] Int. Cl.[2] ..... A46B 3/00
[58] Field of Search ..... 300/21; 29/120

[56] References Cited

UNITED STATES PATENTS

| | | | |
|---|---|---|---|
| 2,447,241 | 8/1948 | Englund | 300/21 |
| 3,295,893 | 1/1967 | Adams | 300/21 |
| 3,610,693 | 10/1971 | Solarek | 300/21 |

*Primary Examiner*—Granville Y. Custer, Jr.
*Attorney, Agent, or Firm*—Charles J. Speciale

[57] ABSTRACT

A process for treating a pile material which is ultimately to be made into a toner removal brush used in association with electrophotographic printing which comprises treating the pile substrate material with a saturated aqueous solution of a chemical mixture comprising at various times a surfactant, an alkali metal salt, a source of borate ions and an optical dye, withdrawing excess solution by mechanical means and simultaneously orienting the pile, and preferably allowing the still wet material to dry at ambient or elevated temperature, forming an elongated pile-covered tubular structure with the resulting dried pile material, sizing the tube to desired lengths if necessary, subjecting the dried pile material to a further wetting either with water alone or a saturated aqueous solution of the same chemical mixture above defined, and then subjecting the pile-covered tube to a centrifugal force sufficient to hurl the pile fibers to an erect condition thereby forming a brush with uniquely superior toner removal properties, and the brush nap made by this method.

46 Claims, 4 Drawing Figures

ELECTROPHOTOGRAPHIC TONER REMOVAL BRUSH AND METHOD OF MAKING SAME

BACKGROUND OF THE INVENTION

1 Field of the Invention:

This invention relates generally to toner removal systems in electrophotographic printing machines and specifically to a method for making a new toner removal brush with improved properties.

Description of the Prior Art:

By definition, electrophotographic printing comprises the steps of (1) charging an electrophotographic surface, e.g. of selenium, tellurium, palladium, with a static voltage of about 3,000 volts (2) shielding the selenium surface, such as a plate, with a light pervious layer carrying an opaque image that is to be recorded (3) exposing the combination to a light source that is directed through the shield to the electrophotographic surface, photoreceptor, or drum or plate whereby all the parts of the surface not covered by the opaque image give up their charge (4) dusting (i.e., developing) the plate with carbon or other powder toner (the toner will adhere to the charged portions) and (5) transferring the toner image to paper through the application of an electrostatic field.

Thus it is well recognized that electrophotography or "dry printing" requires the application of a pigmented powder on to the surface of a charged plate (the photoconductor) in order to develop the latent electrostatic images thereon. Thus toner removal becomes quite important if one is to accomplish both the substantial removal of all the toner from the photoconductor drum and at the same time, protect the longevity of the photoconductor drum, as well as the life of the brush.

In the prior art for example, cleaning brushes or wipers are used in drycopying machines or duplicators where such wipers are in contact with the image transferring masters made out of or coated with photoconductive (i.e. photoreceptive) materials and such wipers or brushes attempt to serve the purpose of removing the residual latent image from the photoconductor without damaging or destroying the photoconductor itself. So far this has not been fully accomplished in the prior art and the brush fiber ends retain fused toner and/or either become clogged with toner material after relatively few turns of the brush against the photoconductor (the brush develops the same charge as the photoconductor, such charge arcing over toner particles and fusing the toner); or the brushes are made such that they scar and damage the photoconductor drum. Representative U.S. Patents in the art of electrophotography and toner removal, just to name a few include U.S. Pat. No. 2,297,691; 2,859,673; 2,911,330; 2,944,147; 2,959,153; and 3,093,039.

SUMMARY OF THE INVENTION

It is therefore among the principal objectives of this invention to provide a toner removal brush having a tremendously increased longevity in terms of the number of images produced by the copier before the brush becomes unusable and must be replaced and just as importantly, to provide a toner removal brush of improved properties such that it will not scratch or prematurely erode the sensitive surface of the photoconductor, and to improve system recovery speed resulting in total system improvements.

In accordance with the present invention, there is now provided a method for making a brush which will have these properties aforementioned. The brush made by the present invention is superior even to the one obtained by the method of making that brush disclosed in my copending application filed concurrently herewith entitled "PROCESS FOR TREATING PILE MATERIALS MADE INTO ELECTROPHOTOGRAPHIC TONER REMOVAL BRUSHES", Ser. No. 625,050. Indeed, the pile substrate in the finished product of the instant invention is believed to have a chemically altered composition. The present method comprises treating a pile substrate material, which has been previously cut into elongated strips and back coated, e.g. latex, with a saturated aqueous solution of a chemical mixture comprising at various times a surfactant, an alkali metal salt, a source of borate ions and an optical dye, withdrawing excess solution by mechanical means and simultaneously orienting the pile, and preferably allowing the still wet material to dry at ambient or elevated temperature, forming an elongated pile-covered tubular structure with the resulting dried pile material, sizing the tube to desired lengths if necessary, subjecting the dried pile material to a further wetting either with water alone or a saturated aqueous solution of the same chemical mixture above defined, and then subjecting the pile-covered tube to a centrifugal force which resultingly hurls the nap to an erect condition to form a brush with uniquely superior toner removal properties, and the brush nap made by this method.

BRIEF DESCRIPTION OF THE DRAWINGS

The invention will be hereinafter more fully described with reference to the accompanying drawing in which.

DESCRIPTION OF THE PREFERRED EMBODIMENTS

Figure 1:
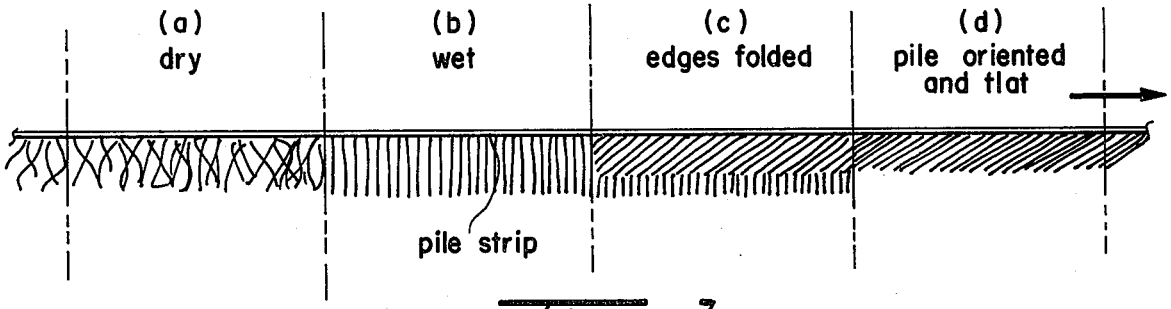
FIG. 1 shows diagrammatically the various stages of the pile material as it is treated according to the method of the invention.

Describing the process now in further detail, a hollow multi or/monofilament natural or synthetic, preferably synthetic hollow filament, and preferably rayon, latex back coated pile substrate material is cut into elongated strips, e.g. about 15 to 30 yards in length and about 3-¼ inches wide, but this is not critical and dimensions can vary. Each strip is then passed through a bath containing a saturated aqueous solution of a chemical mixture (Bath I, see Table I below) comprising at various times a surfactant, an alkali metal salt, e.g. sodium metasilicate, sodium phosphate, a source of borate ions, e.g. boric acid and sodium borate, the solution can also be sprayed on, thoroughly soaking it, and the strip is next passed over a source of suction such as a vacuum connected nap folding fixture head, as described in my copending application filed concurrently herewith, entitled "COMBINATION NAP-FOLDING FIXTURE HEAD, Ser. No. 625,049." The purpose of the suction is two-fold. First, it removes loose fabric and excess solution from the strip, shortening ultimate drying time, and secondly, the pile nap is folded flat and oriented in one direction, and more importantly the fabric nap is edge-folded (lateral edges) for a reason which will be subsequently described hereinbelow. While vacuum suction is the preferred method of edge-folding the fabric nap, it is to be understood that this step can also be accomplished by streams of air directed at the edges. It is also to be understood that the edges can be vacuumed while a rotating brush combs the nap unidirectionally simultaneously. The strip is then allowed to dry at room temperature or slightly elevated for faster drying. This step can be omitted according to another specific embodiment of the invention, as will be discussed hereinbelow.

When the strip is dry, it is applied to a tubular core (preferably cylindrical), e.g. Kraft lined cardboard, by butt winding (edge to edge) or gap winding, or overlap winding, preferably butt winding. This is a critical step in that the core should be covered in a predetermined pattern. It can now be seen why the edge-folding step is so important. By this step clean straight lateral edges are obtained which will not be trapped in the winding seam. If the ragged edges were allowed to remain and become caught in the winding seam, the brush would not present a uniform nap and the seam windings would be visible through capillary seepage of the adhesive. Instead of winding strips a sleeve can also be made and fitted over the core. The sleeve or strip is bonded to the core by applying an adhesive to the core before fitting. As a precaution, a coloring agent is mixed in the adhesive, to contrast to the fabric color, whose purpose is to signal invasion of the adhesive to the brush which would have a serious deleterious effect on the uniformity of the brush nap and the adhesive would mar the photoconductor surface as well. Next, the adhesive is allowed to dry and following this, the pile covered core is cut to size. Of course, the cores can be pre-cut before pile covering. In the event, and this is preferable, the pile covered core is cut to size, it is important that it be cut at a 90° angle thereto and when cutting a vacuum force is applied in conjunction therewith to force the pile in an erect position. The angle of the cut and the vacuum associated therewith prevents the cutting across of fibers and partial loss of nap.

Thereafter, critically the pile on the core should be thoroughly wet, additionally wetting it with water or saturated aqueous chemical mixture (Bath II, Table I below), taking care not to wet the core ends and taking care that preferably the pile remains oriented, i.e. as originally uni-directional. In this retreated or rewetted condition the nap is hurled to an erect condition, thereby forming a brush, by subjecting it to a centrifugal force which results from a high speed rotation of the nap away from the core, i.e. each strand thus being positioned to be perpendicular to the rotational axis of the core. In this case, the core is inserted over a rotatable spindle and the wet nap is touched to a high speed rotating texturing brush. Since the highest degree of erectness of the nap which can be accomplished is a function of the accelerating centrifugal forces exerted on the liquid which is moving through the strands making up the nap, therefore the higher the degree of the acceleration the more prestressing of each strand is accomplished. Conversely, the core can be rotated at high speed in a plane perpendicular to the centrifugal hurling force. The centrifugal hurling time should be sufficient to bring the centrifugal force at the end of the nap to its full potential to bring the fibers erect, increase their density by imploding the fiber walls via the escape of the liquid solution caused by the centrifugal force, and resulting in the fibers having a prestressed state in the dry condition. Bath I and Bath II as previously indicated may vary and in order to more fully appreciate this feature, Table I immediately hereinbelow illustrates the bath variations:

TABLE I

| VARIATION | BATH I | vs. | BATH II |
|---|---|---|---|
| A | Water, sodium metasilicate, optical dye, surfactant* | | Water, sodium metasilicate, optical dye, surfactant* |
| B | Water, sodium phosphate,** Boric Acid, optical dye | | Water, sodium metasilicate and sodium phosphate, optic dye, surfactant |
| C | Water, Boric Acid, Sodium Metasilicate | | Water, sodium metasilicate and sodium phosphate, surfactant |
| D | Water, Surfactant, Boric Acid | | Water, sodium metasilicate and sodium phosphate, surfactant, Boric Acid |
| E | Water, Boric Acid | | Water, Sodium Metasilicate and sodium phosphate, surfactant |
| F | Water | | Water, sodium metasilicate and sodium phosphate, surfactant, boric acid, optical |
| G | Water, sodium metasilicate and sodium phosphate, surfactant, Boric Acid, Optical dye | | Water |

*Contain same charge
**Can be any one of the sodium phosphates, e.g. monobasic, dibasic, tribasic, etc.

After the centrifugal hurling thereby forming the final product the outside diameter of the brush can be sized by cutting to desired machine specifications, and allowed to dry before use, or preferably dried before sizing.

The requirement that the pile substrate material be formed of hollow monofilament fibers is of preference in this invention in that it is believed that the aqueous chemical mixture reacts with the rayon filament to form a new derivative thereof and moreover the residual chemicals remaining after centrifugal action have been forced up to the upper part of the hollow filament filling the hollow interior thereof to the tip of the nap. Thus, there is chemical change as well as molecular loading of the hollow fiber. It is further believed that the heavier components, e.g., the metallic ions, form the upper area of the brush nap whereas the lighter and more viscous components remain in the lower portions of the hollow filament. The heavier upper portion of the nap is the area of higher conductivity. Moreover, the fiber walls remain linked by capillary lock. When the aforesaid centrifugal force is applied, the fiber tends to stretch and there is an increased density taking place. Thus, the elastic memory of the individual nap fibers is increased, i.e. tendency to return to erect state.

The surfactant in the chemical mixture is anionic or cationic and can be any one of a number of commercially available surfactants; the latter is not critical. The optical dyes employed will vary depending on the charge on the photoconductor drum. For example, optical yellow has a shorter wave length and optical pink have a longer wave length and each would be used accordingly. Where the photoreceptor charge is positive, toner would have negative charge, or the photoreceptor charge is negative, toner would have positive charge, respectively. Thus, when the brush rubs against the photoconductor drum, the inter-strand spaces pick up the same charge as the toner and at the same time it carries the toner off the drum. Being of like charge as the brush end nap-spaces, the toner will be repelled thereby and will not foul or clog the brush. This phenomenon imparts "self-adapting polarity" to the brushes made by this invention and is a tremendous advance in the art. The repelled toner can be picked up in a filter using a vacuum as is conventionally done in present dry copy machines.

Figure 3:
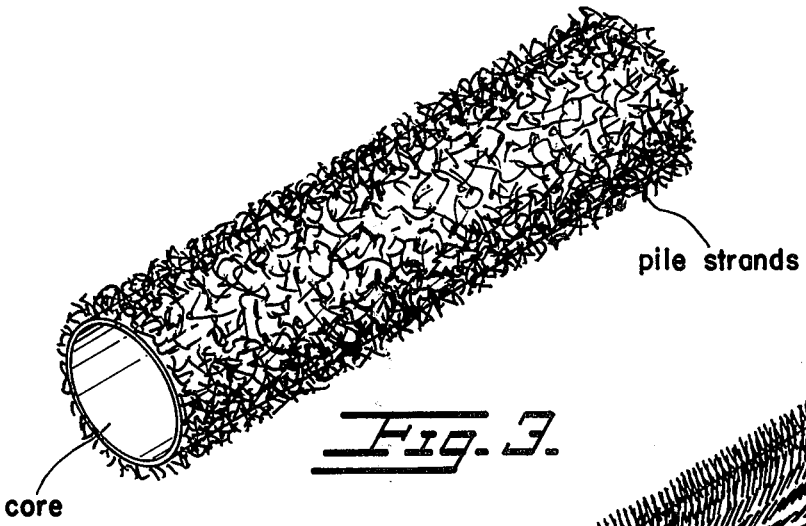
FIG. 3 shows in perspective a pile covered tube just before the centrifugal hurling treatment.
Figure 4:
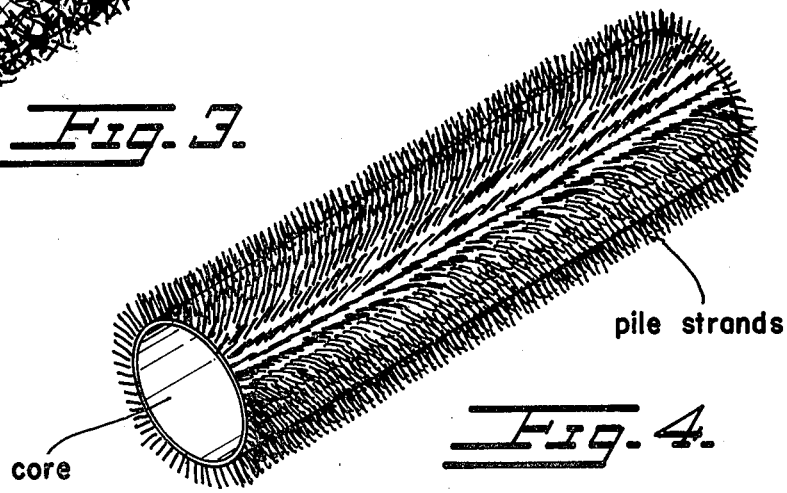
FIG. 4 shows in perspective the toner removal brush formed after centrifugal hurling.

Table II immediately hereinbelow summarizes the method steps of the invention illustrating the various embodiments of the invention.

edges are folded in and pile is flat and unidirectional. FIG. 3 shows the pile on the brush before centrifugal hurling i.e., before subjection of tubular core to centrifugal force and FIG. 4 shows the pile strands in an erect position after hurling.

When employed in extant dry copying machines, the toner removal brushes made by this invention show a remarkable longevity over the prior art brushes providing a cleaner system extending the service life of the system. The invention brushes are stiff enough to clean more toner from the photoconductor yet soft enough not to damage the photoconductor drum. The brushes also remain toner clog free for many, many reproductions by the drum reducing significantly the number of service changes of brush and drum and providing more consistent copy quality. Indeed, the present brush is remarkably superior even to the brush described in the aforesaid copending application and remains in active service for tens of thousands more reproductions. By virtue of its "self-adapting polarity" the invention brush is still more prone to being and remaining toner clog free. It has also been found that improvements of the toner removal system, of which the brush is the critical component, afford the performance acceleration of the total system, extending service periods, resulting in reduced cost per copy.

What is claimed is:

1. A method of making an electrophotographic toner removal brush which comprises treating a pile substrate material with a saturated aqueous solution of a first chemical mixture comprising an alkali metal salt and a source of borate ions, withdrawing excess solution therefrom, and simultaneously orienting the pile, allowing the still solution wet pile material to dry, applying the resulting dried pile material to an elongated tubular base core and subjecting said dried pile to further treatment with a saturated aqueous solution of a second chemical mixture comprising two alkali metal salts and a surfactant and finally subjecting said further treated pile material to a centrifugal force sufficient to hurl the

TABLE II

| | STEPS | | | | | | | | |
|---|---|---|---|---|---|---|---|---|---|
| | 1 | 2 | 3 | 4 | 5 | 6 | 7 | 8 | 9 |
| Method | Substrate Wetting | Edging Orienting | Drying | Winding | Cutting | Wetting | Exploding | Drying | Sizing (O.D.) |
| A | Wetting with Chemical Bath I | Yes | Yes | Yes | Yes | Yes, with Chemical Bath II | Yes | Yes | Yes |
| B | Wetting with Chemical Bath I and II | Yes | Yes | Yes | Yes | Yes, with water | Yes | Yes | Yes |
| C | Wetting with Chemical Bath I and II | Yes | No | Yes | Yes | No | Yes | Yes | Yes |
| D | Wetting with water | Yes | Yes | Yes | Yes | Yes, wetting with Chemical Bath I and II | Yes | Yes | Yes |
| E | Wetting with water | Yes | No | Yes | Yes | Yes, wetting with Chemical Bath I and II | Yes | Yes | Yes |

NOTE
Comparing Table I with Table II it can be seen that the combinations of steps and bath variations are numerous.

Figure 2:
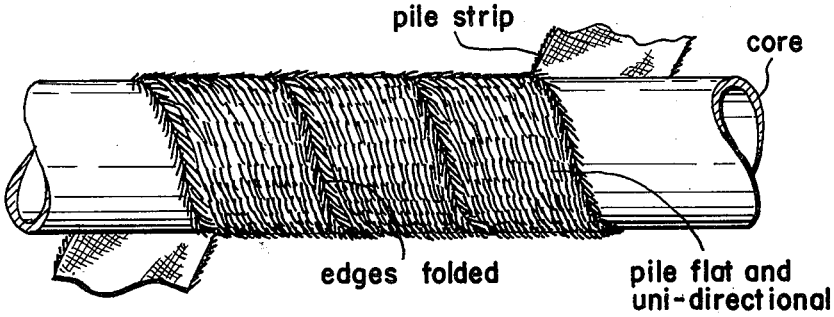
FIG. 2 shows a strip of the invention treated pile material in strip form as shown partially wound around a tube core.

Referring now to the figures of the drawing in terms of the method of invention just described hereinabove, there is shown in FIG. 1, a diagrammatic representation of a pile substrate strip at various stages of treatment: (a) the dry untreated substrate (b) immediately after wetting (c) edges folded by vacuum (d) pile oriented unidirectionally and flat. FIG. 2 shows a fragment of a wet (or dry) strip butt-wound around a core; note pile fibers to an erect condition thereby forming a brush nap wherein the density of each pile fiber has been increased by rapid centrifugal removal of the solution therefrom and allowing the brush nap to dry.

2. A method according to claim 1 wherein said first chemical mixture further comprises additionally an optical dye, and said second chemical mixture further comprises additionally an optical dye.

3. A method according to claim 2 wherein said source of borate ions is boric acid, and said alkali metal salt comprises sodium phosphate in said first mixture and said two alkali metal salts comprise sodium metasilicate and sodium phosphate in said second mixture.

4. The electrophotographic toner removal brush made by the method of claim 3.

5. A method according to claim 1 wherein said pile substrate material is in the form of an elongated strip, and wherein said excess solution in said strip is withdrawn by means of a suction force so that the resulting pile is flat and uni-directional and its edges folded inwardly.

6. A method according to claim 5 wherein said strip is adhesively bondably applied to said base core.

7. A method according to claim 6 wherein a coloring agent is mixed with said adhesive.

8. A method according to claim 5 wherein said strip is applied by butt-winding around said elongated tubular core.

9. A method according to claim 8 wherein said pile-covered tubular core is sized by cutting at desired intervals at substantially right angles to the tube in simultaneous association with a vacuum force before said centrifugal force is exerted.

10. The electrophotographic toner removal brush made by the method of claim 1.

11. A method of making an electrophotographic toner removal brush which comprises treating a pile substrate material with a saturated aqueous solution of a first and second chemical mixture, wherein said first chemical mixture comprises an alkali metal salt and a source of borate ions and said second chemical mixture comprises two alkali metal salts and a surfactant, withdrawing excess solution therefrom and simultaneously orienting the pile, allowing the still solution wet pile material to dry, applying the resultant dried pile material to an elongated tubular base core and subjecting said dried pile material to further treatment with an aqueous medium and finally subjecting the said further treated pile material to a centrifugal force sufficient to hurl the pile fibers to an erect condition thereby forming a brush nap wherein the density of each pile fiber has been increased by rapid centrifugal removal of the solution therefrom and allowing the brush nap to dry.

12. A method according to claim 11 wherein said first chemical mixture further comprises additionally an optical dye, and said second chemical mixture further comprises additionally an optical dye.

13. A method according to claim 12 wherein said source of borate ions is boric acid and said alkali metal salt comprises sodium phosphate in said first mixture and said two alkali metal salts comprise sodium metasilicate and sodium phosphate in said second mixture.

14. A method according to claim 11 wherein said pile substrate material is in the form of an elongated strip, and wherein said excess solution in said strip is withdrawn by means of a suction force so that the resulting pile is flat and uni-directional and its edges folded inwardly.

15. A method according to claim 14 wherein said strip is adhesively bondably applied to said base core.

16. A method according to claim 15 wherein a coloring agent is mixed with said adhesive.

17. A method according to claim 14 wherein said strip is applied by butt-winding around said elongated tubular core.

18. A method according to claim 17 wherein said pile-covered tubular core is sized by cutting at desired intervals at substantially right angles to the tube in simultaneous association with a vacuum force before said centrifugal force is exerted.

19. The electrophotographic toner removal brush made by the method of claim 11.

20. A method of making an electrophotographic toner removal brush which comprises treating a pile substrate material with a saturated aqueous solution of a first and second chemical mixture, wherein said first chemical mixture comprises an alkali metal salt and a source of borate ions and said second chemical mixture comprises two alkali metal salts and a surfactant, withdrawing excess solution therefrom and simultaneously orienting the pile, applying the resultant still solution wet pile material to an elongated tubular base core and subjecting said solution wet pile material to a centrifugal force sufficient to hurl the pile fibers to an erect condition, thereby forming a brush nap wherein the density of each pile fiber has been increased by rapid centrifugal removal of the solution therefrom and allowing the brush nap to dry.

21. A method according to claim 20 wherein said first chemical mixture further comprises additionally an optical dye, and said second chemical mixture further comprises additionally an optical dye.

22. A method according to claim 21 wherein said source of borate ions is boric acid, and said alkali metal salt comprises sodium phosphate in said first mixture and said two alkali metal salts comprise sodium metasilicate and sodium phosphate in said second mixture.

23. The electrophotographic toner removal brush made by the method of claim 20.

24. A method of making an electrophotographic toner removal brush which treating a pile substrate material with an aqueous medium, withdrawing excess moisture therefrom and simultaneously orienting the pile, applying the resultant still wet pile material to an elongated tubular base core, subjecting said wet pile material to further treatment with a saturated aqueous solution of a first and second chemical mixture, wherein said first chemical mixture comprises an alkali metal salt and a source of borate ions and said second chemical mixture comprises two alkali metal salts and a surfactant, and finally subjecting said further treated pile material to a centrifugal force sufficient to hurl the pile fibers to an erect condition thereby forming a brush nap wherein the density of each pile fiber has been increased by rapid centrifugal removal of the solution therefrom and allowing the brush nap to dry.

25. A method according to claim 24 wherein said wet pile material is allowed to dry before it is applied to said elongated tubular base core.

26. The electrophotographic toner removal brush made by the method of claim 25.

27. The electrophotographic toner removal brush made by the method of claim 24.

28. A method of making an electrophotographic toner removal brush which comprises treating a pile substrate material with an aqueous medium, withdrawing excess moisture therefrom and simultaneously orienting the pile, applying the resultant wet pile material to an elongated tubular base, subjecting said wet pile material to further treatment with a saturated aqueous solution of at least one alkali metal salt, a surfactant, a source of borate ions and an optical dye.

29. A method according to claim 28 wherein said wet pile material is allowed to dry before it is applied to said elongated tubular base core.

30. A method according to claim 29 wherein the treating steps are reversed.

31. A method of making an electrophotographic toner removal brush which comprises treating a pile substrate material with a saturated aqueous solution of a first chemical mixture, withdrawing excess solution therefrom and simultaneously orienting the pile, allowing the still solution wet pile material to dry, applying the resulting dried pile material to an elongated tubular base core and subjecting said dried pile to further treatment with a saturated aqueous solution of a second chemical mixture wherein said first and second chemical mixtures are the same and each comprises a surfactant, an alkali metal salt, and an optical dye, and finally subjecting said further treated pile material to a centrifugal force sufficient to hurl the pile fibers to an erect condition thereby forming a brush nap wherein the density of each pile fiber has been increased by rapid centrifugal removal of the solution therefrom and allowing the brush nap to dry.

32. A method according to claim 31 wherein said alkali metal salt comprises sodium metasilicate.

33. The electrophotographic toner removal brush made by the method of claim 31.

34. A method of making an electrophotographic toner removal brush which comprises treating a pile substrate material with a saturated aqueous solution of a first chemical mixture comprising a source of borate ions, withdrawing excess solution therefrom, and simultaneously orienting the pile, allowing the still solution wet pile material to dry, applying the resulting dried pile material to an elongated tubular base core and subjecting said dried pile to further treatment with a saturated aqueous solution of a second chemical mixture comprising two alkali metal salts and a surfactant and finally subjecting said further treated pile material to a centrifugal force sufficient to hurl the pile fibers to an erect condition thereby forming a brush nap wherein the density of each pile fiber has been increased by rapid centrifugal removal of the solution therefrom and allowing the brush nap to dry.

35. A method according to claim 34 wherein said first chemical mixture comprises additionally a surfactant and said second chemical mixture further comprises additionally a source of borate ions.

36. A method of making an electrophotographic toner removal brush which comprises treating a pile substrate material with a saturated aqueous solution of a first and second chemical mixture, wherein said first and second chemical mixtures are the same and each comprises a surfactant, an alkali metal salt, and an optical dye, withdrawing excess solution therefrom and simultaneously orienting the pile, allowing the still solution wet material to dry, applying the resultant dried pile material to an elongated tubular base core and subjecting said dried pile material to further treatment with an aqueous medium and finally subjecting said further treated pile material to a centrifugal force sufficient to hurl the pile fibers to an erect condition thereby forming a brush nap wherein the density of each pile fiber has been increased by rapid centrifugal removal of the solution therefrom and allowing the brush nap to dry.

37. A method according to claim 36 wherein said alkali metal salt comprises sodium metasilicate.

38. The electrophotographic toner removal brush made by the method of claim 36.

39. A method of making an electrophotographic toner removal brush which comprises treating a pile substrate material with a saturated aqueous solution of a first and second chemical mixture, wherein said first chemical mixture comprises a source of borate ions and said second chemical mixture comprises two alkali metal salts and a surfactant, withdrawing excess solution therefrom and simultaneously orienting the pile, allowing the still solution wet pile material to dry, applying the resultant dried pile material to an elongated tubular base core and subjecting said dried pile material to further treatment with an aqueous medium and finally subjecting said further treated pile material to a centrifugal force sufficient to hurl the pile fibers to an erect condition thereby forming a brush nap wherein the density of each pile fiber has been increased by rapid centrifugal removal of the solution therefrom and allowing the brush nap to dry.

40. A method according to claim 39 wherein said first chemical mixture comprises additionally a surfactant and said second chemical mixture further comprises additionally a source of borate ions.

41. A method of making an electrophotographic toner removal brush which comprises treating a pile substrate material with a saturated aqueous solution of a first and second chemical mixture, wherein said first and second chemical mixtures are the same and each comprises a surfactant, an alkali metal salt and an optical dye, withdrawing excess solution therefrom and simultaneously orienting the pile, applying the resultant still solution wet pile material to an elongated tubular base core and subjecting said solution wet pile material to a centrifugal force sufficient to hurl the pile fibers to an erect condition, thereby forming a brush nap wherein the density of each pile fiber has been increased by rapid centrifugal removal of the solution therefrom and allowing the brush nap to dry.

42. A method according to claim 41 wherein said alkali metal salt comprises sodium metasilicate.

43. A method of making an electrophotographic toner removal brush which comprises treating a pile substrate material with a saturated aqueous solution of a first and second chemical mixture, wherein said first chemical mixture comprises a source of borate ions and said second chemical mixture comprises two alkali metal salts and a surfactant, withdrawing excess solution therefrom and simultaneously orienting the pile, applying the resultant still solution wet pile material to an elongated tubular base core and subjecting said solution wet pile material to a centrifugal force sufficient to hurl the pile fibers to an erect condition, thereby forming a brush nap wherein the density of each pile fiber has been increased by rapid centrifugal removal of the solution therefrom and allowing the brush nap to dry.

44. A method according to claim 43 wherein said first chemical mixture comprises additionally a surfactant and said second chemical mixture further comprises additionally a source of borate ions.

45. A method of making an electrophotographic toner removal brush which comprises treating a pile substrate material with an aqueous medium, withdrawing excess moisture therefrom and simultaneously orienting the pile, applying the resultant still wet pile material to an elongated tubular base core, subjecting said wet pile material to further treatment with a saturated aqueous solution of a first and second chemical mixture wherein said first and second chemical mixtures are the same and each comprises a surfactant, an alkali metal salt and an optical dye, and finally subjecting said further treated pile material to a centrifugal force sufficient to hurl the pile fibers to an erect condition thereby forming a brush nap wherein the density of each pile fiber has been increased by rapid centrifugal removal of the solution therefrom and allowing the brush nap to dry.

46. A method of making an electrophotographic toner removal brush which comprises treating a pile substrate material with an aqueous medium, withdrawing excess moisture therefrom and simultaneously orienting the pile, allowing the still solution wet material to dry, applying the resultant dried pile material to an elongated tubular base core, subjecting said dried pile material to further treatment with a saturated aqueous solution of a first and second chemical mixture, wherein said first and second chemical mixtures are the same and each comprises a surfactant an alkali metal salt and an optical dye, and finally subjecting said further treated pile material to a centrifugal force sufficient to hurl the pile fibers to an erect condition thereby forming a brush nap wherein the density of each pile fiber has been increased by rapid centrifugal removal of the solution therefrom and allowing the brush nap to dry.

* * * * *